US007689136B2

(12) United States Patent
Nakase et al.

(10) Patent No.: US 7,689,136 B2
(45) Date of Patent: Mar. 30, 2010

(54) IMAGE FORMING APPARATUS CAPABLE OF SWITCHING IMAGE ADJUSTMENT PROCESS ACCORDING TO AN ENVIRONMENT CONDITION

(75) Inventors: Takahiro Nakase, Toride (JP); Naoyuki Yamamoto, Toride (JP); Hitoshi Suzuki, Matsudo (JP); Toshiharu Kondo, Moriya (JP); Yasuhiro Yoshimura, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1183 days.

(21) Appl. No.: 11/252,609

(22) Filed: Oct. 19, 2005

(65) Prior Publication Data

US 2006/0098996 A1 May 11, 2006

(30) Foreign Application Priority Data

Oct. 22, 2004 (JP) ..... 2004-308686

(51) Int. Cl.
*G03G 15/00* (2006.01)

(52) U.S. Cl. ..... 399/44

(58) Field of Classification Search ..... 399/44, 399/48, 50, 51, 55, 94, 97
See application file for complete search history.

(56) References Cited

U.S. PATENT DOCUMENTS 4,592,646 A * 6/1986 Suzuki et al. ..... 399/43
4,797,707 A * 1/1989 Iwahashi et al. ..... 399/43
5,057,867 A * 10/1991 Ishigaki et al. ..... 399/43
5,317,367 A * 5/1994 Pierce et al. ..... 399/38
5,548,378 A * 8/1996 Ogata et al. ..... 399/13
5,771,421 A * 6/1998 Kim ..... 399/44
5,887,223 A * 3/1999 Sakai et al. ..... 399/60
5,966,557 A * 10/1999 Wada ..... 399/43
6,427,055 B2 * 7/2002 Sawada ..... 399/44
6,463,226 B2 * 10/2002 Kitajima et al. ..... 399/44
7,031,625 B2 * 4/2006 Ebe ..... 399/44

FOREIGN PATENT DOCUMENTS

JP 08110678 A * 4/1996
JP 09101655 A * 4/1997
JP 2000131925 A * 5/2000
JP 2000-181196 6/2000
JP 2001312124 A * 11/2001
JP 2003228199 A * 8/2003

* cited by examiner

*Primary Examiner*—Robert Beatty
(74) *Attorney, Agent, or Firm*—Fitzpatrick, Cella, Harper & Scinto

(57) ABSTRACT

The present invention aims to reduce the time period of the start up operation of an image forming apparatus corresponding to an image forming apparatus operating environment. The present invention provides an image forming apparatus includes an image bearing member; a toner image forming unit for forming a toner image on the image bearing member; an image condition detection member for detecting an image condition of the image bearing member; a setting unit for setting a plurality of toner image forming conditions determined based on the output of the image condition detection member; an environment detection member for detecting an environment condition of outside air of the image forming apparatus; and a selection unit for selecting the toner image forming conditions set by the setting unit based on the output of the environment detection device from when the power is turned on to when transitioned to an image formable state.

5 Claims, 13 Drawing Sheets

| ADJUSTMENT PRIORITY | ADJUSTMENT ORDER | ADJUSTMENT ITEMS | ADJUSTMENT TIME PERIOD | NECESSARY ADJUSTMENT ITEMS | | |
|---|---|---|---|---|---|---|
| | | | | NORMAL (1ST) | LOW TEMPERATURE (2ND) | HIGH HUMIDITY (THIRD) |
| 1 | 3 | DEVELOPING | 2 SEC | ○ | ○ | ○ |
| 2 | 2 | CHARGING | 10 SEC | | ○ | |
| 3 | 1 | EXPOSING | 10 SEC | | ○ | △ |

○ : ADJUSTMENT NECESSARY ITEMS
△ : ITEMS OF IMPROVING ACCURACY BY ADJUSTMENT DUE TO EXTRA TIME
( ) : IMAGE FORMING CONDITION DETERMINATION MODE

| ADJUSTMENT PRIORITY | ADJUSTMENT ORDER | ADJUSTMENT ITEMS | ADJUSTMENT TIME PERIOD | NECESSARY ADJUSTMENT ITEMS | | |
|---|---|---|---|---|---|---|
| | | | | NORMAL (1ST) | LOW TEMPERATURE (2ND) | HIGH HUMIDITY (THIRD) |
| 1 | 3 | DEVELOPING | 2 SEC | ○ | ○ | ○ |
| 2 | 2 | CHARGING | 10 SEC | | ○ | |
| 3 | 1 | EXPOSING | 10 SEC | | ○ | △ |

○ : ADJUSTMENT NECESSARY ITEMS

△ : ITEMS OF IMPROVING ACCURACY BY ADJUSTMENT DUE TO EXTRA TIME ( ) : IMAGE FORMING CONDITION DETERMINATION MODE

PRIOR ART

PRIOR ART

PRIOR ART

IMAGE FORMING APPARATUS CAPABLE OF SWITCHING IMAGE ADJUSTMENT PROCESS ACCORDING TO AN ENVIRONMENT CONDITION

BACKGROUND OF THE INVENTION

1. Field of the invention

The present invention relates to an electro-photographic image forming apparatus such as a printer, a copying machine, a facsimile and the like for electrostatically forming an image.

2. Related Background Art

The start up time period of the image forming apparatus such as the printer, the copying machine, the facsimile and the like greatly depends on the temperature of the fixing device. That is, in these image forming apparatuses, the start up time period from when the power is turned on to when starting up to the image formable state is greatly influenced by the time it takes for the fixing device to reach the temperature capable of performing fixation.

In order to reduce the start up time period, in recent years, the fixing roller is made thinner or an induction heating fixing method and the like is adopted. In the latter induction heating fixing method, the heat is generated at the fixing roller and the like by the eddy current produced by the magnetic field generated by the current flowing through the coil.

Consequently, the influence of the fixing device on the start up time period is reduced. On the contrary, there is increased the influence of factors, other than the fixing device, on the start up time period of the image forming apparatus, for example, the start up time period of an auxiliary device such as a feeder for reading the document or a finisher for sorting the output paper, or a potential control time of the photosensitive surface for outputting an appropriate image and the like.

This will be explained with reference to FIG. 12. In the figure, the axis of abscissa indicates time and the axis of ordinate indicates electric power. As shown in the figure, if the start up time period (warm up time period) of the fixing device is long, the start up time period of the auxiliary device and the potential control time are within the start up time period of the fixing device, and thus the time required until the image formable state is not greatly influenced. However, if the start up time period of the fixing device is reduced as shown in FIG. 13, the time required until the image formable state is greatly influenced by the start up time period of the auxiliary device and the potential control time. In order to reduce the influence of the time for potential control, a method of omitting the step for potential control to reduce the time period is disclosed in Japanese Patent Application Laid-Open No. 2000-181196, as shown in FIG. 14.

However, if the step for potential control is uniformly reduced, the problem in that the image stability may lack depending on the image forming operating environment arises.

Further, depending on the image forming operating environment, the time until image formable state may differ. For instance, under a low temperature environment in which the start up time period of the fixing device is significantly longer than the normal environment, or under a high temperature high humidity environment that requires a drum rotating time for removing the moisture adhered, due to high humidity, to the photosensitive member (photosensitive drum) with a drum heater, the time until transitioning to the image formable state becomes longer than normal due to factors other than the potential control.

Thus, depending on the image forming operating environment, the adjustment items for performing image formation is made uniform irrespective of the difference in time for transitioning to the image formable state, and when performing the remaining adjusting items after transitioning to the image formable state, the following problems arise. The start up time period becomes longer due to other factors, and even if there is extra time to perform the remaining adjusting items, the time for transitioning to the image formable state takes a long time, and further, the down time caused by implementation of the remaining adjusting items occur even if transitioned to the image formable state, thereby lowering the usability.

SUMMARY OF THE INVENTION

The present invention aims to reduce the time period of the start up operation of the image forming apparatus corresponding to the image forming apparatus operating environment.

Another object of the present invention is to provide an image forming apparatus includes an image bearing member; toner image forming means for forming a toner image on the image bearing member; an image condition detection member for detecting an image condition of the image bearing member; setting means for setting a plurality of toner image forming conditions determined based on the output of the image condition detection member; an environment detection member for detecting an environment condition of outside air of the image forming apparatus; and selection means for selecting the toner image forming conditions set by the setting means based on the output of the environment detection means from when the power is turned on to when transitioned to an image formable state.

Still another object of the present invention will be clearly understood from the following description.

DETAILED DESCRIPTION OF THE PREFERRED EMBODIMENTS

Figure 1:
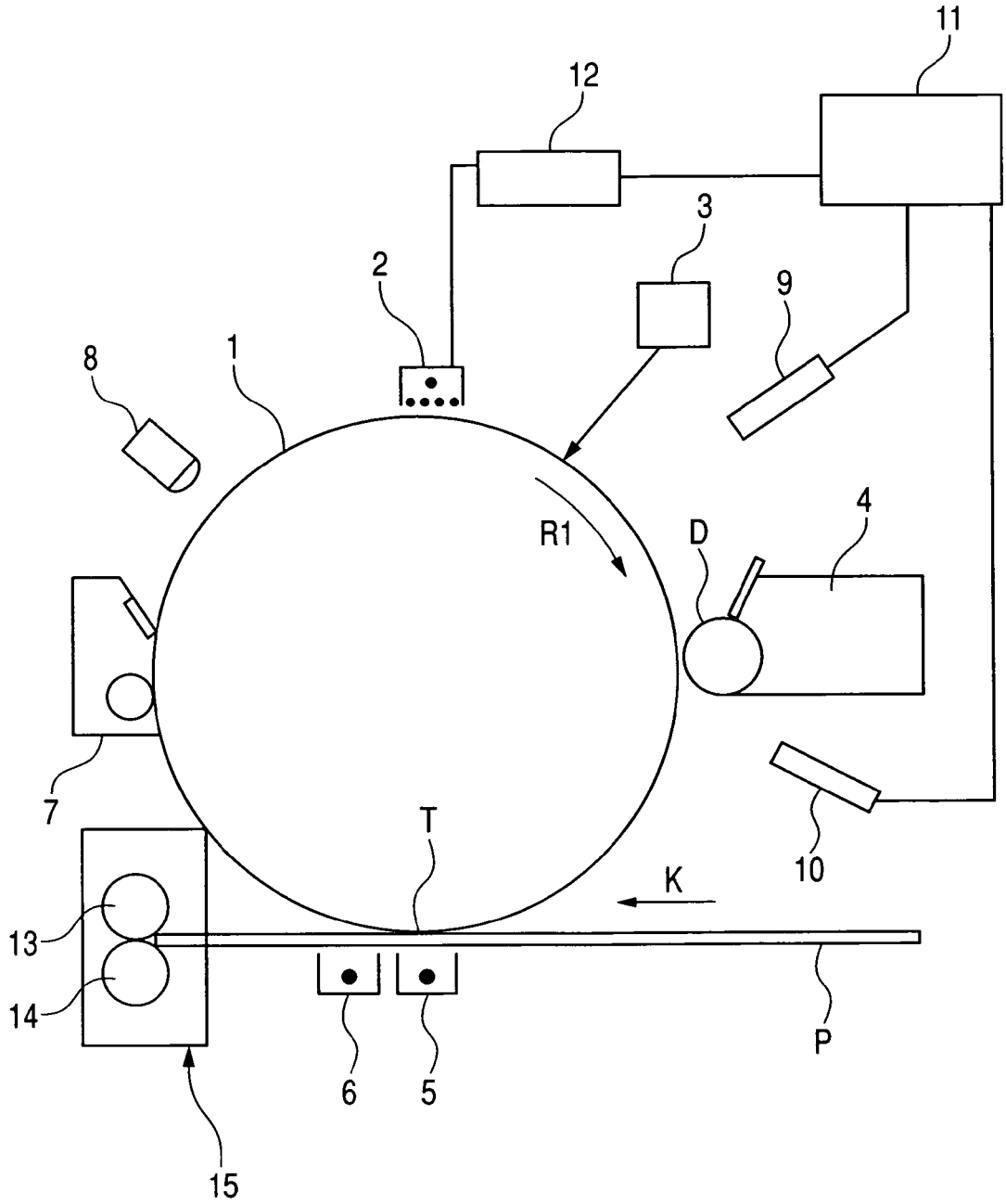
FIG. 1 is a longitudinal sectional view showing a schematic configuration of an image forming apparatus to which the present invention is applicable.

The embodiments of the present invention will now be described with reference to the drawings. It is to be noted that in each figure, the same reference characters are denoted for the same configuration or operation, and thus the redundant description thereof will be appropriately omitted.

Embodiment 1

FIG. 1 shows an image forming apparatus to which the present invention can be applied. The image forming apparatus shown in the figure is an electro-photographic image forming apparatus, and the figure is a longitudinal sectional view showing the schematic configuration of the main portion.

The outline of the configuration of the entire image forming apparatus will be described with reference to FIG. 1.

The image forming apparatus shown in the figure includes a drum type electro-photographic photosensitive member (hereinafter referred to as "photosensitive drum") as an image bearing member. The photosensitive drum 1 is rotatably supported in the direction of the arrow R1 by the image forming apparatus main body (not shown).

A primary charging device (charging means) 2, an exposing apparatus (exposing means) 3, a developing apparatus (developing means) 4, a transfer charging device (transferring means) 5, a charge separation device (separating means) 6, a cleaning apparatus (cleaning means) 7, and a pre-exposing apparatus (pre-exposing means) 8 are arranged on the periphery of the photosensitive drum 1 substantially in order along the rotating direction thereof. A potential sensor (image condition detection member) 9 serving as a surface potential detection member for detecting the potential of the surface of the photosensitive drum is arranged on the downstream side of the exposing apparatus 3 and on upstream side of the developing apparatus (developing means) 4 along the rotating direction of the photosensitive drum 1, and a toner bearing amount sensor 10 for detecting the bearing amount of the toner of the toner image is arranged on the downstream side of the developing apparatus 4 and on the upstream side of the transfer charging device 5, the image condition detection member 9 and the toner bearing amount sensor 10 each being arranged so as to face the surface of the photosensitive drum 1. In the present embodiment, toner image forming means includes the charging means, the exposing means, and the developing means. The outputs of the potential sensor 9 and the toner bearing amount sensor 10 are sent to controlling means (CPU) 11. Based on the output of the potential sensor 9, one of or all the conditions of the toner image forming means is set with setting means included in the controlling means 11. In other words, the charging bias is set in case of the charging means, the exposing amount is set in case of the exposing means, and the value of the developing bias is set in case of the developing means. Further, a charging bias application power source 12 controlled by the controlling means 11 is connected to the primary charging device 2. The controlling means 11 includes selection means for selecting the toner image forming conditions set by the setting means based on the output of an environment detection member from when the power is turned on to when transitioned to the image formable state as hereinafter described.

Further, on the upstream side of the transfer charging device 5 along the conveying direction (direction of arrow K) of the transferring material P (for example, paper, recording material of transparent film and the like) serving as a recording medium where the toner image (image) is formed, sheet feeding/conveying means (for example, sheet feeding cassette, sheet feeding roller, conveying roller, resist roller) (all of which are not shown) for feeding and conveying the transferring material P is arranged. On the downstream side of the charge separation device 6 along the conveying direction of the transferring material P, a fixing roller 13, a pressurizing roller 14, and a fixing device (image heating means) 15 including an image heating temperature detection member for detecting the temperature of the fixing roller are arranged.

The operation of the image forming apparatus of the above configuration will now be described.

In the above image forming apparatus, during image formation, driving means (not shown) rotatably drives the photosensitive drum 1 at a predetermined process speed (peripheral velocity) in the direction of the arrow R1.

The surface of the photosensitive drum 1 is uniformly (evenly) charged with a predetermined polarity and potential by the primary charging device 2 applied with charging bias by the charging bias application power source 12. The surface of the photosensitive drum 1 that has been charged is subjected to light irradiation based on the image information by the exposing apparatus 3, and the charges of the light irradiated portion is removed thereby forming electrostatic latent image. The electrostatic latent image is, due to application of developing bias to the developing apparatus 4, adhered with the toner including charges and developed as a toner image in the developing portion D.

The toner image formed on the photosensitive drum 1 in this way is then reached to the transferring portion T between the photosensitive drum 1 and the transfer charging device 5 by the rotation in the direction of the arrow R1 of the photosensitive drum 1. At the timing the toner image reaches the transferring portion T, the transferring material P is fed to the transferring portion T by the sheet feeding/conveying means. The toner image of the photosensitive drum 1 is electrostatically transferred to the transferring material P as the transferring bias of opposite polarity from the toner image is applied to the transfer charging device 5.

The transferring material P after toner image transfer is separated from the surface of the photosensitive drum 1 when the separation bias is applied to the charge separation device 6. The photosensitive drum 1 from which the transferring material P is separated has the toner (toner remaining after transfer) that has not been transferred to the transferring material P and is remaining on the surface in the transfer removed by the cleaning apparatus 7, and the charges remaining on the surface are removed by the pre-exposing apparatus 8 and provided for the next image formation.

The transferring material P separated from the surface of the photosensitive drum 1 is, on the other hand, conveyed to the fixing device 15 and is heated and pressurized when passing between the fixing roller 13 and the pressurizing roller 14 so that the toner image is fixed on the surface. The transferring material P after the toner image fixation is discharged outside of the image forming apparatus main body (not shown). The image formation on one transferring material P is thereby completed.

In the image forming apparatus, various sensors including the potential sensor 9 and the toner bearing amount sensor 10 are arranged. For example, a sensor for detecting the position of the transferring material P, a sensor for detecting the operation of each member or equipment and the timing thereof, a sensor for detecting the voltage applied to each member or equipment and the timing thereof, a temperature sensor for detecting the temperature of each member or equipment, a temperature/humidity sensor (environment detection member) for detecting the temperature/humidity of the atmosphere, i.e., environment, in the vicinity of each member or the equipment and the like are arranged at a suitable position as necessary. The detection results of these sensors are sent to the controlling means 11. The controlling means controls based on the detection results, the speed or timing of the operation of each member or equipment, the magnitude of the voltage or the application timing.

The flow of the processes in the image forming apparatus from when the user turns on the power of the image forming apparatus to when the image formable state is reached will now be schematically described with reference to the flow chart of FIG. 2. The reference characters S1, S2 . . . in the figure indicate the procedure (step) number (same for flow charts of FIG. 3 to FIG. 6 to be hereinafter described).

The power of the image forming apparatus is turned on (S1) by the user, and simultaneously, the image forming apparatus checks whether the temperatures of the fixing device circumference and the photosensitive drum circumference are cooled to about the environmental temperature by the temperature sensor (S2). It is to be noted that the second temperature detection means detects the temperature of the fixing device circumference, and the third temperature detection means detects the temperature of the photosensitive drum circumference. The first temperature detection means detects the temperature of the atmosphere, i.e., environment, of the image forming apparatus circumference.

If the temperatures of the fixing device circumference and the photosensitive drum circumference are not cooled (NO if S2) to about the environmental temperature, the step proceeds to the standby sequence (S3) to be hereinafter described. On the other, if determined that the temperatures are cooled (YES of S2), the warm up sequence is started (S4). In the warm up sequence, one of or a plurality of the temperatures of the environment, the relative humidity, and the absolute humidity are checked (S5). The warm up for the necessary portions is then started (S6). In this environment, in consideration of the time when image adjustment can be performed, the essential item for image adjustment (toner image forming condition to be set) is selected (S7). The essential item for image adjustment selected by the selection means is then performed (S8). At the point both various warm ups and image adjustment are finished (YES of S9), "ready to copy" is displayed on a displaying portion (not shown) of the image forming apparatus main body and is now in the image formable state (S10). The warm up sequence is then finished (S11).

Subsequently, the standby sequence of S3 of FIG. 2 will now be described with reference to FIG. 3.

Figure 2:
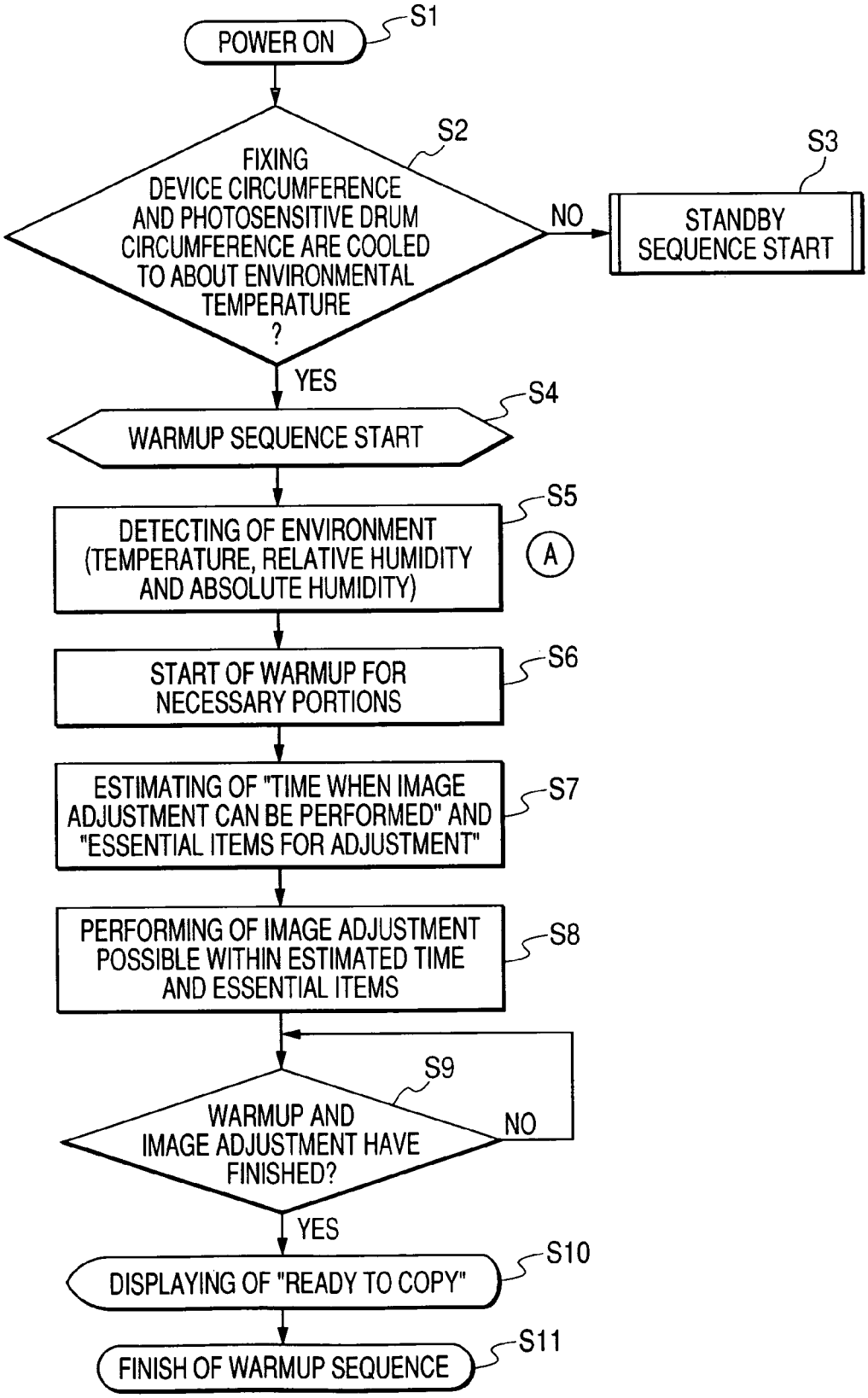
FIG. 2 is a flow chart showing a warm up sequence.

When determined that the temperatures of the fixing device circumference and the photosensitive drum circumference are not cooled to about the environmental temperature in S2 of FIG. 2, that is, when determined that the temperatures are higher than a predetermined temperature (NO of S2) when the power is turned on, the standby sequence is started (S3).

Figure 3:
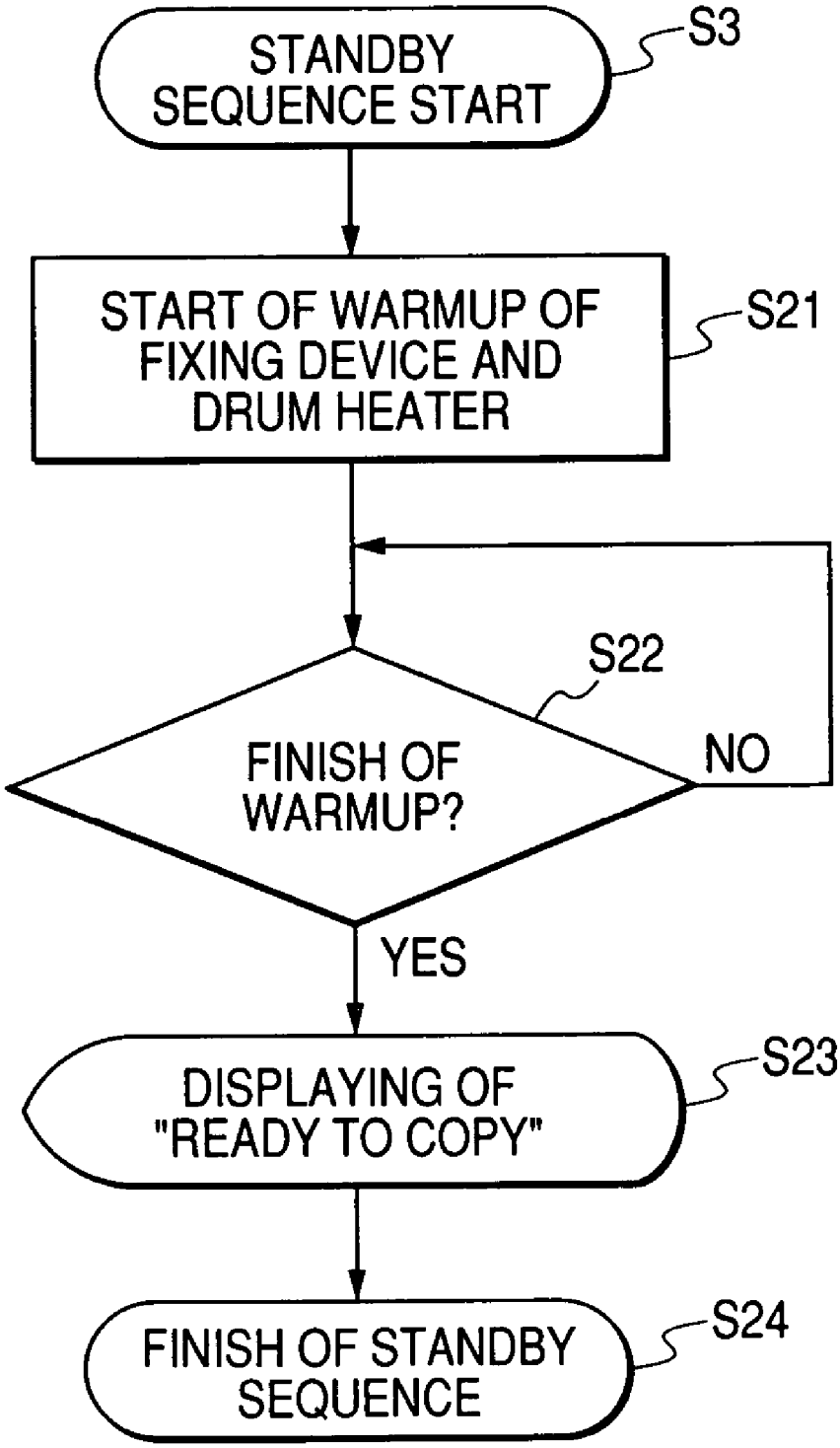
FIG. 3 is a flow chart showing a standby sequence.

As shown in the flow chart of FIG. 3, when the standby sequence is started (S3), with the turning on of the power, the warm up of the fixing device and if necessary, the drum heater (heater for warming the surface of the photosensitive drum) is started (S21). The drum heater is a device for preventing the generation of an image that seems smudged generated under high humidity environment, also referred to as "image smudging". When both the temperature of the fixing device and the surface temperature of the photosensitive drum reach a predetermined target temperature, the warm up is finished (YES of S22), "ready to copy" is displayed (S23) and the standby sequence is finished (S24). As the situation within the apparatus of the image forming apparatus is considered to not have greatly changed from the previous power on, image adjustment is not particularly carried out. That is, the selection means is not functioned.

Figure 4:
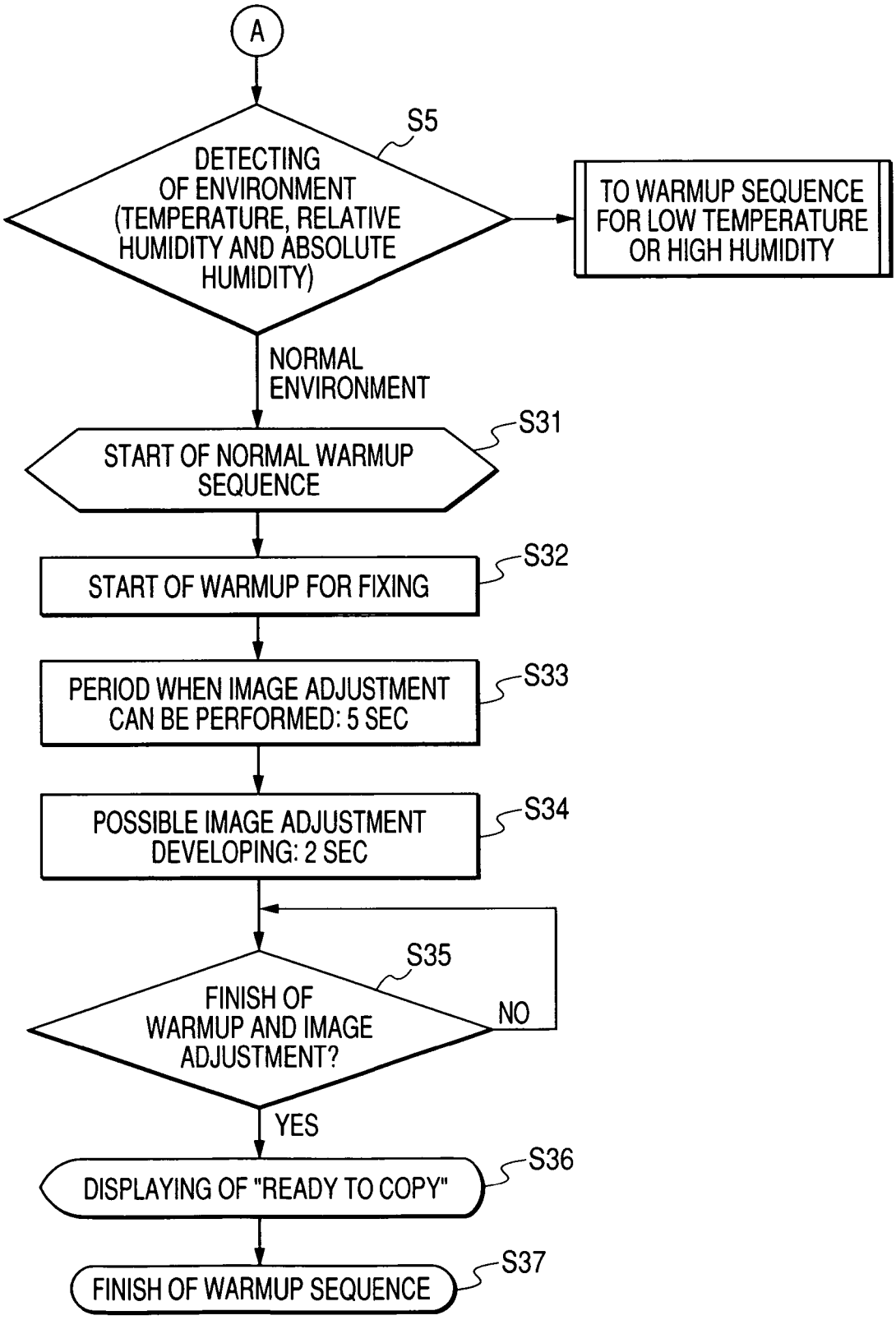
FIG. 4 is a flow chart showing a warm up sequence under normal environment.
Figure 5:
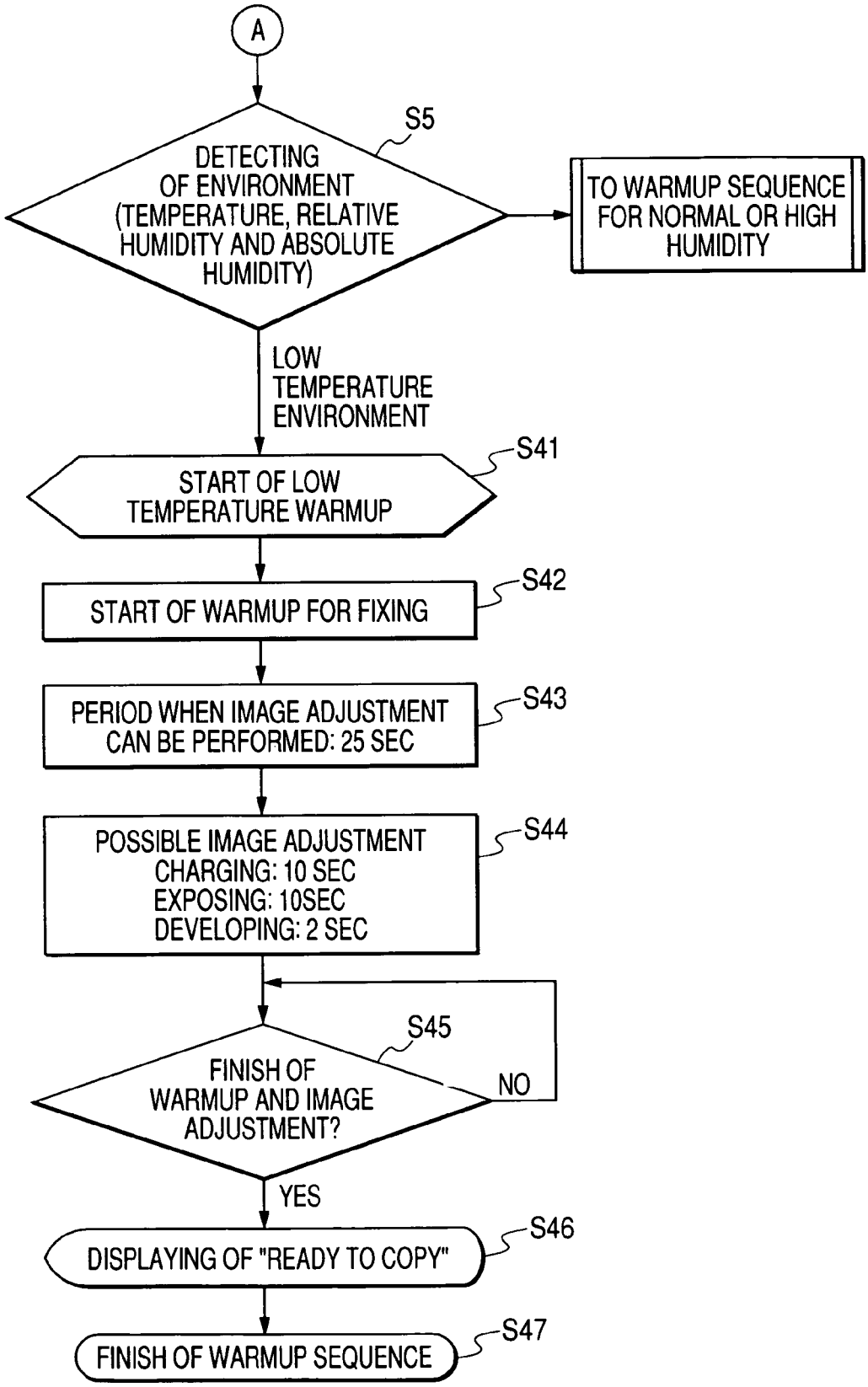
FIG. 5 is a flow chart showing a warm up sequence under low temperature environment.
Figure 6:
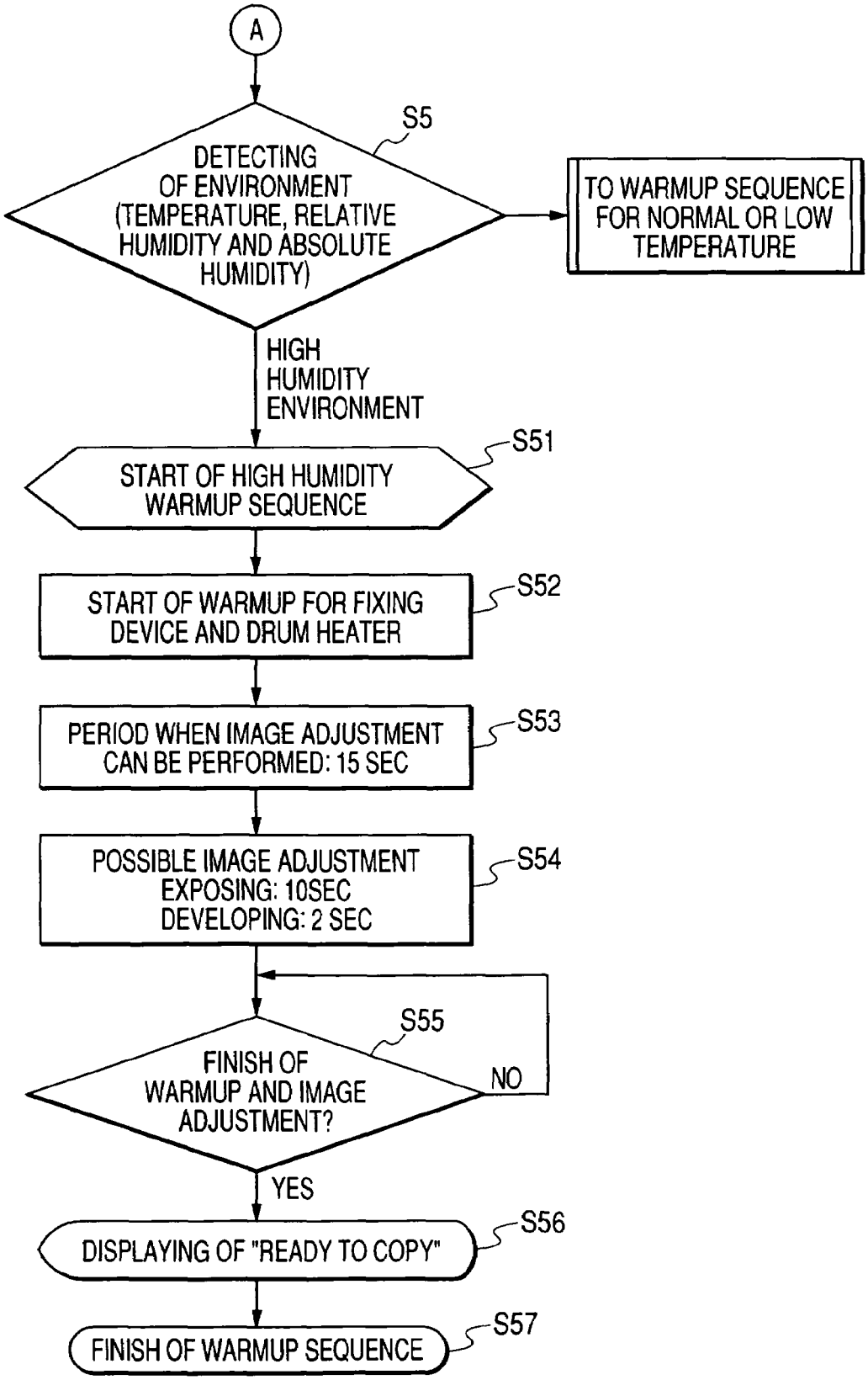
FIG. 6 is a flow chart showing a warm up sequence under high humidity environment.

With reference to the flow charts of FIG. 4, FIG. 5, and FIG. 6, the order thereof, and the warm up under the normal environment, under the low temperature environment, and under the high humidity environment will now be explained in detail.

The warm up under the normal environment will first be explained in detail with reference to FIG. 4.

When the power is turned on, in S5, the detection temperature of a thermistor for detecting the surface temperature of the fixing roller is for example, 40° C. When the temperature is below 50° C., the internal part of the image forming apparatus is determined to be sufficiently cooled to about the environmental temperature, and thus the warm up sequence is started. By means of the environmental sensor arranged inside the image forming apparatus, the temperature of 23° C. and humidity of 50% are detected (S5) and is thus determined as the normal environment, and the sequence of the normal warm up is started (S31). For the warm up under the normal environment, the item is only fixing and thus the warm up for fixing is started (S32). The required time is 30 seconds. However, the time that can be used for image adjustment is 5 seconds due to control of the power and the like (S33). The necessary image adjustment under the normal environment is only developing of a first image forming condition determination mode, as shown in FIG. 7, and the controlling time is 2 seconds.

Figures 7, 8:
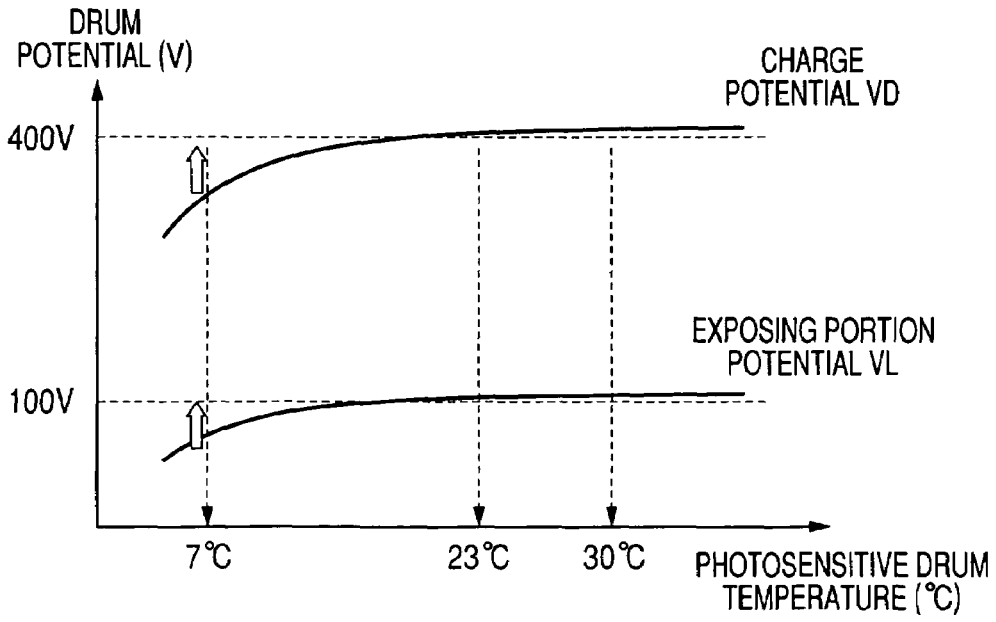
FIG. 7 is a view explaining a first image forming condition determination mode performed under normal environment, a second image forming condition determination mode performed under low temperature environment, and a third image forming condition determination mode performed under high humidity environment.
FIG. 8 is a view explaining the temperature property of the photosensitive drum.

Reference is now made to FIG. 7. The figure includes developing, charging, and exposing for adjustment items, and the respective adjustment time periods are set as 2 seconds, 10 seconds, and 10 seconds, and further has the adjustment priority and the adjustment order determined. In the columns of the necessary adjustment items, o: adjustment necessary items, Δ: items for improving accuracy by adjustment due to extra time are shown each for under normal environment (normal), under low temperature environment (low temperature) and under high humidity environment (high humidity). Based thereon, in the normal environment, the first image forming condition determination mode is executed. In this mode, the selected adjustment item is only developing of adjustment priority 1, and the adjusting time period is 2 seconds. Further, under the low temperature environment, the second image forming condition determination mode is executed. In this mode, the selected adjustment items are all of developing, charging, and exposing of adjustment priority 1, 2, 3 and the respective adjustment time period is 2 seconds, 10 seconds and 10 seconds. The actual adjustment order is the opposite of the adjustment priority. Further, under the high humidity environment, the third image forming condition determination mode is executed. In this mode, the selected adjustment item is only developing of adjustment priority 1 , and the adjusting time period is 2 seconds. However, since there is extra time in this mode, exposition is performed for 10 seconds with the object of improving accuracy by adjustment.

In any one of the environments, if the temperature of the fixing member is higher than a predetermined temperature, transition to the image forming state may occur without performing any adjustments. In this case, the toner image forming condition just before is adopted.

Figure 9:
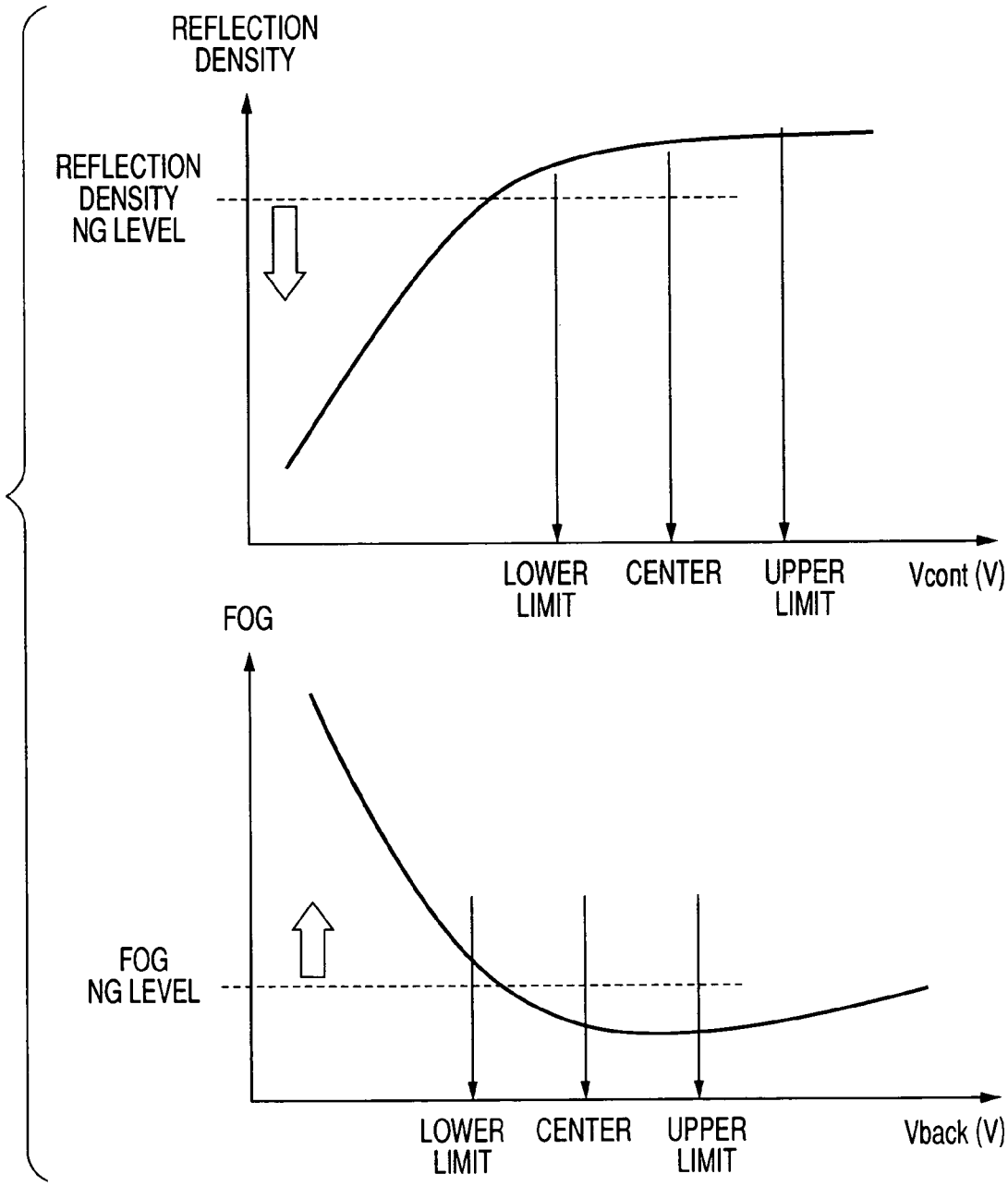
FIG. 9 is a view explaining the relationship between the contrast potential and the reflection density and the relationship between the fog removing potential and the fog.

Since adjustment of charging and exposing is not necessary and there is no time for performing the same under the normal environment, only the adjustment of developing is performed (S34). More specifically, the charge potential VD (dark portion potential) is measured for one circumference of the photosensitive drum, and the developing bias DC component Vdc is set from the above value so that the phenomenon called "fog" in which the white background portion becomes gray does not occur. This is because, as shown in FIG. 9, although the density does not become too low in a range of fluctuation of Vcont (≡Vdc−VL) even if the exposure portion potential VL (dark portion potential) is fluctuated for various reasons, the Vback (≡VD−Vdc) may cause fog due to fluctuation. Thus, at the point the fixing warm up and the image adjustment are finished (YES of S35), "ready to copy" is displayed (S36) on the displaying portion, and the warm up sequence is finished (S37).

Therefore, the time period from when the power is turned on to when the warm up is finished is short or 30 seconds, and a satisfactory image can be output to the user. Further, after the job is finished, the output adjustment of the primary charging device is performed while measuring the potential of the photosensitive drum to have VD as 400V. Under the normal environment, if the VD is set, the VL is not varied by exposing with a predetermined amount of light, and thus a normal image can be continuously output.

The warm up under the low temperature environment will now be explained in detail with reference to FIG. 5.

Figure 10:
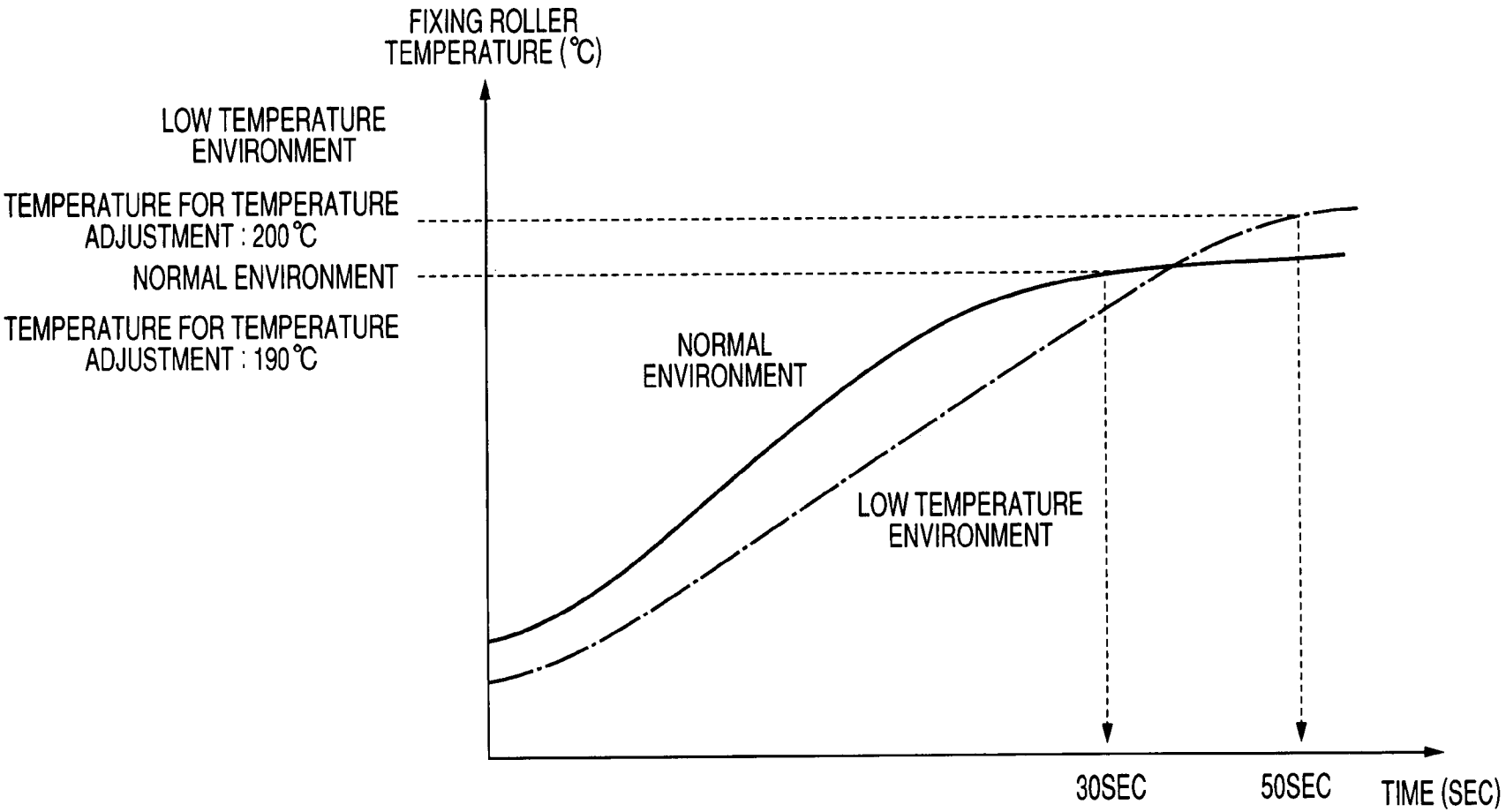
FIG. 10 is a view explaining the relationship between the warm up time period of the fixing device and the fixing roller temperature.

After the power is turned on, similar to the normal environment, the warm up sequence is started. By means of the environmental sensor arranged inside the image forming apparatus, the temperature is 7° C. and thus is determined (S5) to be a low temperature environment. The sequence of the low temperature warm up is started (S42). The warm up item under the low temperature environment is only fixing (S42), similar to the normal environment, but the warm up time period is 45 seconds. The reasons for this is that, as shown in FIG. 10, the initial fixing roller temperature is low, the target temperature is high or 200° C. in the low temperature environment as opposed 190° C. in the normal environment and that the temperature increase is late since the environmental temperature is low even if the same power is supplied to the fixing device. However, the time that can be used for image adjustment is 25 seconds due to control of the power and the like (S43). As shown in FIG. 8, the photosensitive drum used in the present embodiment has a temperature property in that the charge potential VD and the exposure portion potential VL lower in the low temperature environment compared to other environments when the outputs of the primary charging device and the exposing apparatus are made constant. In order to correct the portion shown with an arrow in the figure, in the low temperature environment, all of developing, exposing, and primary charging must be adjusted in the second image forming condition determination mode. The controlling time is 22 seconds as seen from FIG. 7 (S44).

The image adjustment is, started 25 seconds after the start of fixing warm up. More specifically, the output adjustment of the primary charging device is performed while measuring the potential of the photosensitive drum to have the VD as 400V. Similarly, the output adjustment of the exposing apparatus is performed to have the VL as 100V. Finally, developing bias is set so as not to cause fog, similar to the above, from the VD 400V.

In this way, at the point the fixing warm up and the image adjustment are finished (S45), "ready to copy" is displayed on the displaying portion, and the warm up sequence is finished (S47).

Therefore, the time period from when the power is turned on to when the warm up is finished is short or 47 seconds, and a satisfactory image can be output.

The warm up under high humidity environment will now be explained in detail with reference to FIG. 6.

After the power is turned on, similar to the normal environment, the warm up sequence is started. By means of the environment sensor arranged inside the image forming apparatus, the absolute humidity is 16 g/kg (corresponding to temperature of 30° C., humidity of 60%) and thus is determined (S5) to be a high humidity environment. The sequence of the high humidity warm up is started (S51). The warm up item under the high humidity environment includes, in addition to fixing, rotation of developer carrying member performed to increase the charging amount of the developer in the developing device so as not to lower the density. The rotation of the developer carrying member is set to be 40 seconds. Further, fixing is 30 seconds, similar to the normal environment. However, the time that can be used for image adjustment is 15 seconds due to control of the power and the like (S53). Under high humidity environment, the temperature property of the photosensitive drum as seen under the low temperature environment is not greatly seen, and the necessary adjustment item is only developing. However, since an extra time exists to perform adjustment of the exposure portion from FIG. 7, the third image forming condition determination mode is performed, and the controlling time becomes 12 seconds (S54).

The image adjustment is started 25 seconds after the start of fixing warm up. More specifically, the output adjustment of the exposing apparatus is performed while measuring the potential of the photosensitive drum to have the VL as 100V. The charge potential VD is measured for one circumference of the photosensitive drum 1, and the developing bias DC component is set from the above value so that the phenomenon known as "fog" in which the white background portion becomes gray does not occur. In this way, at the point the fixing warm up and the image adjustment are finished (YES of S55), "ready to copy" is displayed (S56) on the displaying portion, and the warm up sequence is finished (S57).

Therefore, the time period from when the power is turned on to when the warm up is finished is 40 seconds, and a satisfactory image can be output in a short period of time without lowering of density.

Under harsh environments such as low temperature or high humidity, the correction of the subsequent image adjustment does not need to be performed by performing the normal image adjustment at the start up, and thus the user does not need to wait.

Embodiment 2

In the present embodiment, the warm up is performed using a timer for measuring the uncontrolled time period under the low temperature environment. It is to be noted that the control under the normal environment and the configuration of the image forming apparatus are the same as in the above described embodiment 1 and the description thereof is not repeated.

When the power is turned on, the time elapsed from when the power is turned off is known to be four hours from the timer (not shown) arranged in the image forming apparatus. This state can be determined as the inside of the image forming apparatus being sufficiently cooled to about the environmental temperature, and thus the warm up sequence is started. By means of the temperature sensor (first temperature detection means (not shown)) arranged inside the image forming apparatus, the temperature is 7° C. and thus is determined to be a low temperature environment. The warm up items under the low temperature environment is only fixing, similar to the normal environment, but the warm up time period is 45 seconds. The time that can be used for image adjustment is 20 seconds. The photosensitive drum used in the present embodiment also has a temperature property in which the charge potential VD and the exposure portion potential VL lower, as explained in FIG. 8, in the low temperature environment compared to other environments when the outputs of the primary charging device and the exposing device are made constant. All of developing, exposing, and primary charging must be adjusted under the low temperature environment to correct the portion shown with the arrow in FIG. 8, and thus and the controlling time takes 22 seconds.

Similar to embodiment 1, after 25 seconds from the start of fixing warm up, the VD and the VL are adjusted, and finally the developing bias is set so as not to cause fog.

Therefore, at the time the fixing warm up and the image adjustment are finished, "ready to copy" is displayed and the warm up sequence is finished. Thus, the time period from when the power is turned on to when the warm up is finished is short or 47 seconds, and the normal image can be output after the start up without particularly waiting the user.

Embodiment 3

In the present embodiment, the warm up under high humidity environment will be explained. In the present embodiment, other than the fact that an amorphous silicon drum is used for the photosensitive drum, the configuration of the image forming apparatus is the same as in embodiment 2.

When the power is turned on, the time elapsed from when the power is turned off is known to be four hours from the timer arranged in the image forming apparatus. This state can be determined as the inside of the image forming apparatus being sufficiently cooled to about the environmental temperature, and thus the warm up sequence is started. By means of a humidity sensor (humidity detection means (not shown) arranged inside the image forming apparatus, the absolute humidity is 16 g/kg (corresponding to temperature of 30° C. and 60%) and thus is determined as high humidity environment. The warm up items under high humidity environment are, in addition to fixing and rotation of the developer carrying member, a drum heater for preventing image smudging.

The amorphous silicon drum is often used in high-speed machines due to its long life time, but has a characteristic of easily causing image smudging and thus often includes a drum heater. Further, since the drum heater is able to maintain the temperature of the photosensitive drum constant, it allows a certain property to be maintained even in the photosensitive drum having temperature property in which the charge potential and the exposure portion potential change with the change in the temperature of the photosensitive member.

Figure 11:
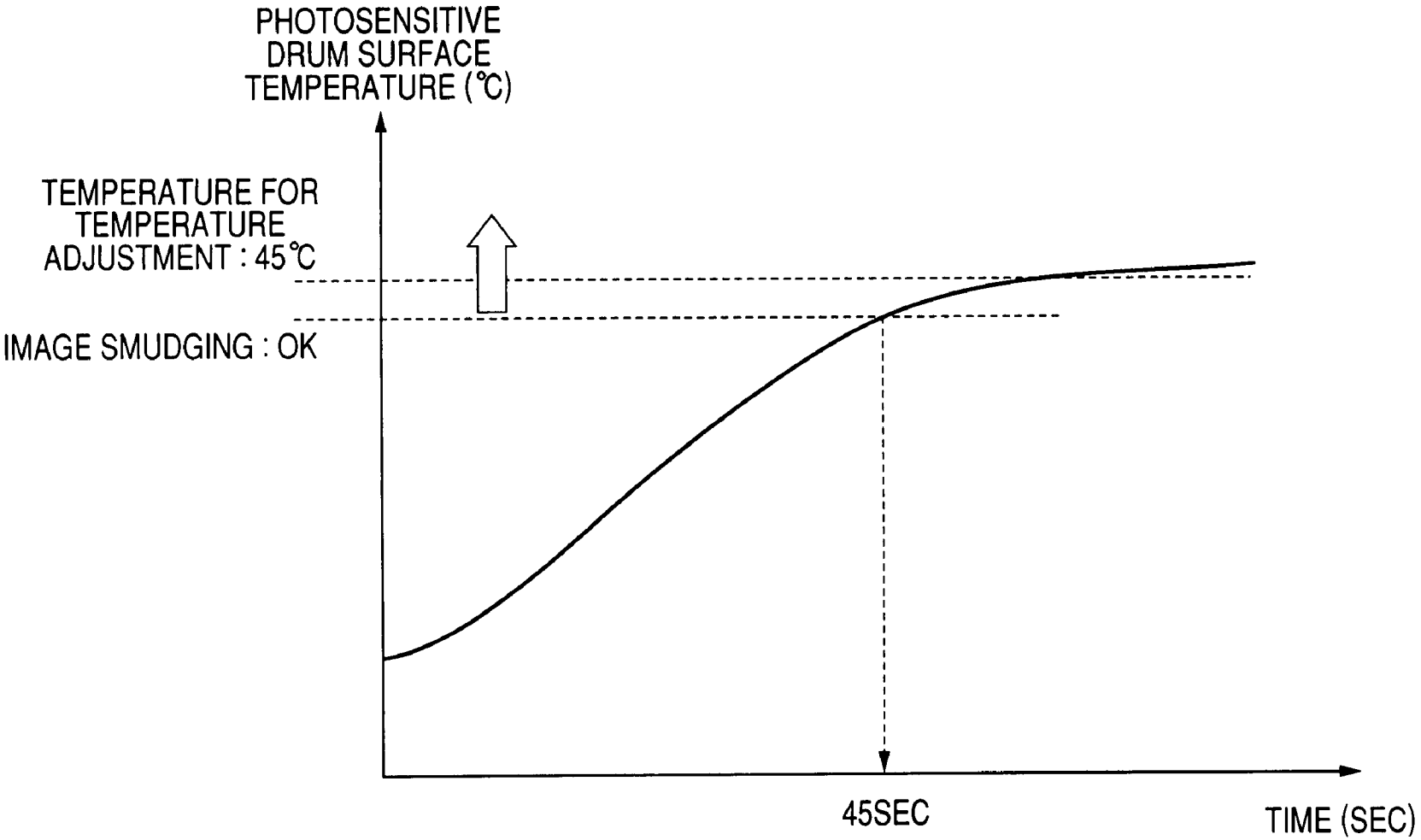
FIG. 11 is a view explaining the relationship between the warm up time period for the photosensitive drum and the surface temperature of the photosensitive drum.
Figure 12:
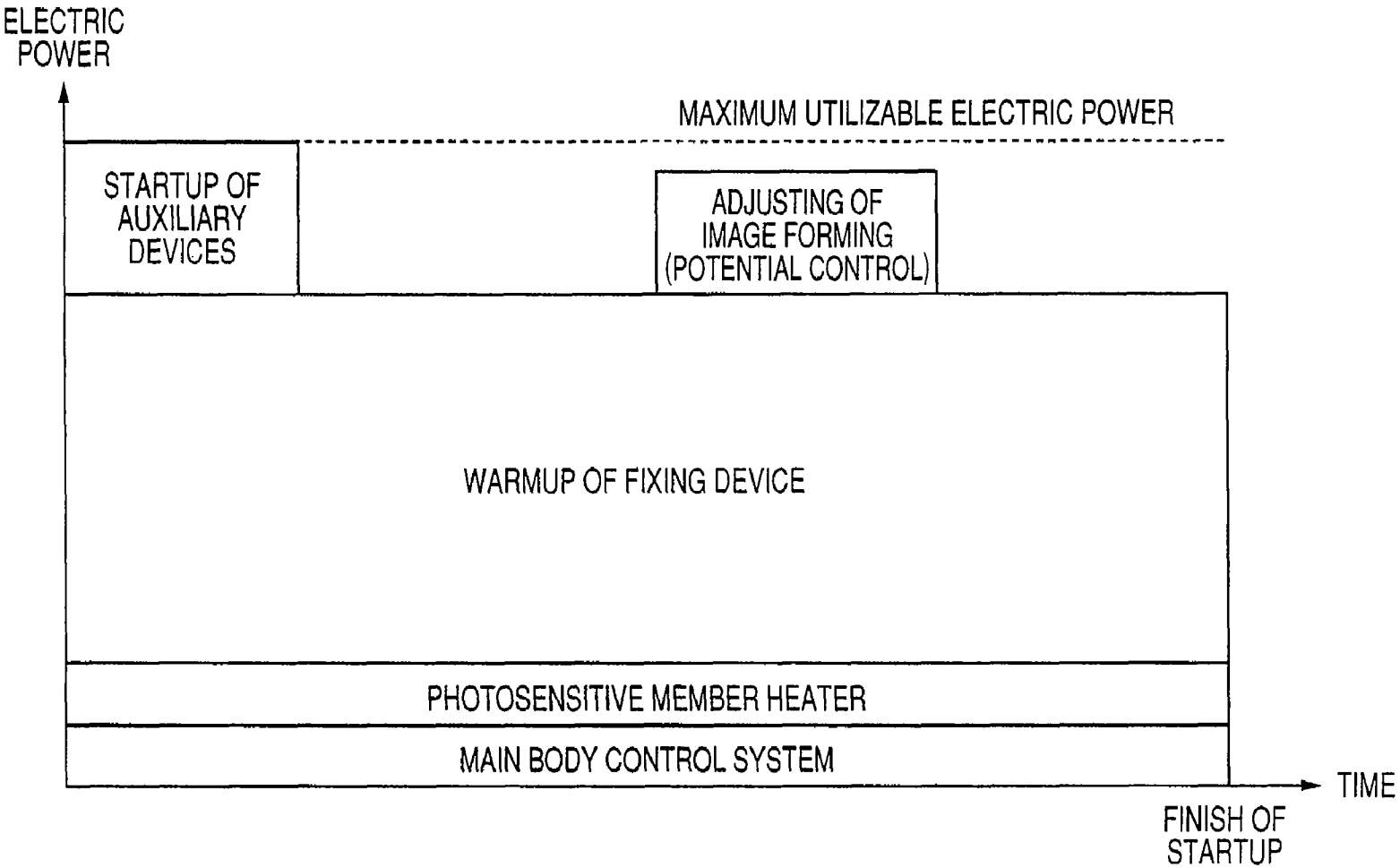
FIG. 12 is a view explaining the conventional relationship between the start up time period and the electric power.
Figure 13:
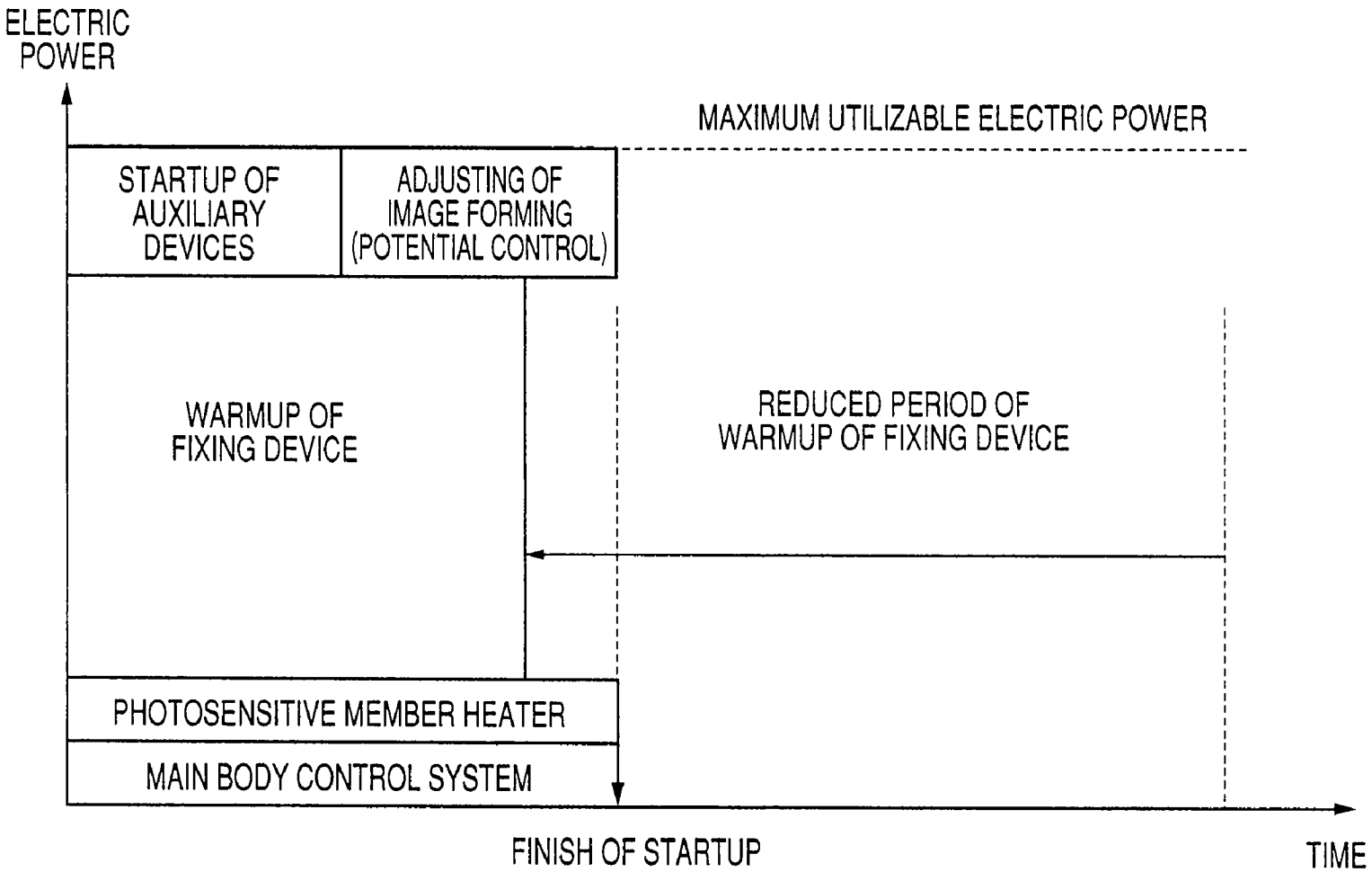
FIG. 13 is a view explaining the relationship between the start up time period and the electric power of when the warm up time period of the fixing device is reduced.
Figure 14:
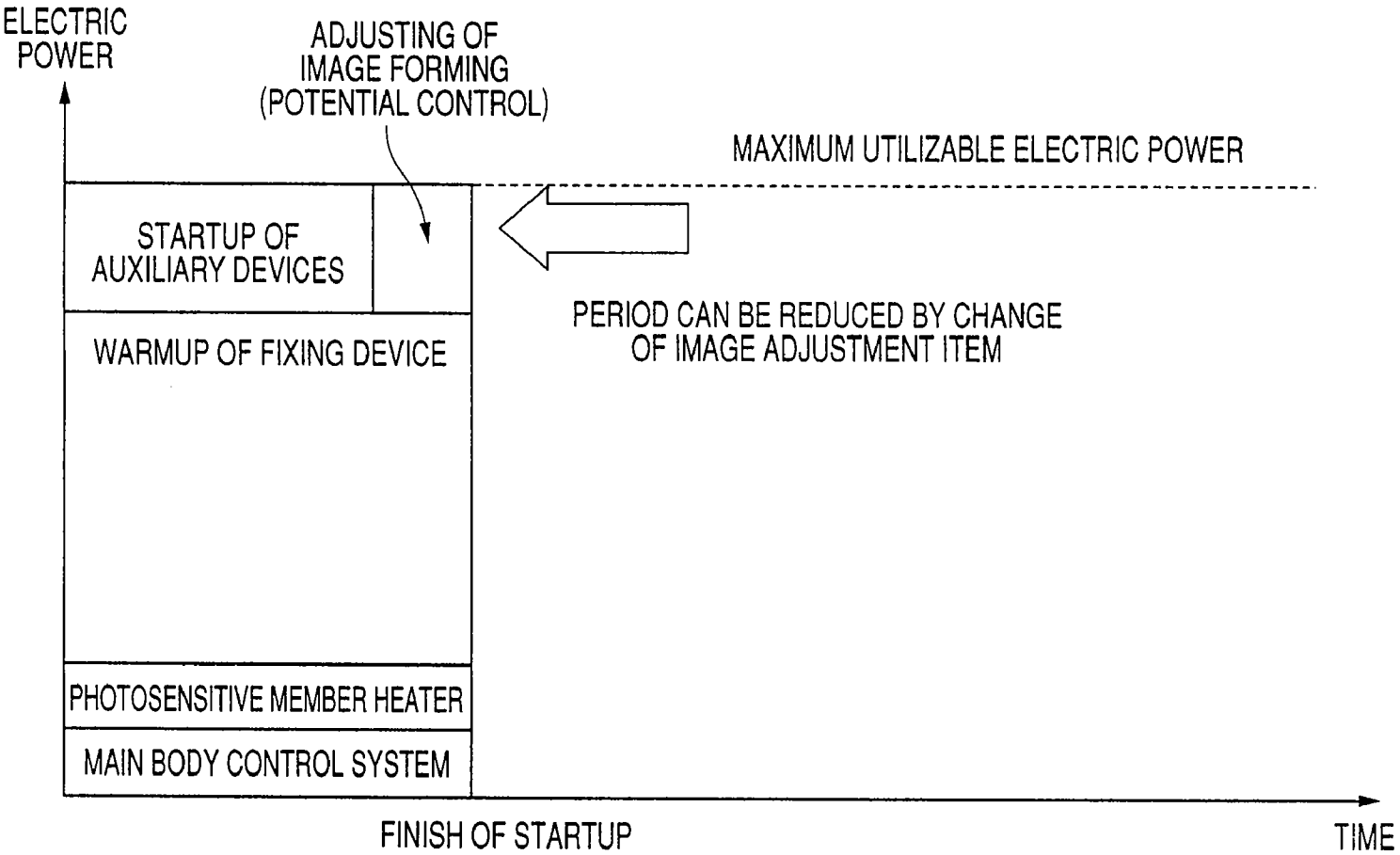
FIG. 14 is a view explaining the relationship between the start up time period and the electric power of when the start up time period is reduced by change of image adjustment item.

In the photosensitive drum used in the present embodiment, as shown in FIG. 11, the surface temperature of the photosensitive drum must be equal to or greater than 40° C. to prevent image smudging, and the warm up time period of the photosensitive drum takes 45 seconds (the temperature of the surface of the photosensitive drum is predicted from time period in the present embodiment, but the surface temperature of the photosensitive drum may be directly measured). Further, fixing is 30 seconds, similar to normal environment. However, the time that can be used for image adjustment is 15 seconds due to control of the power and the like required for the drum heater. Under the high humidity environment, the temperature property of the photosensitive drum as seen under the low temperature environment is not greatly seen, and the necessary adjustment item is only developing. However, since an extra time exists to perform adjustment of exposure portion as seen from FIG. 7, the controlling time period becomes 12 seconds.

Similar to embodiment 1, 30 seconds after the start of fixing warm up, the output adjustment of the exposing apparatus is performed, the charge potential VD is measured for one circumference of the photosensitive drum, and the developing bias DC component is set from the relevant value so as not to cause "fog". Thus, at the point the fixing warm up and the image adjustment are finished, "ready to copy" is displayed, and the warm up sequence is finished.

Therefore, the time period from when the power is turned on to when the warm up is finished is 45 seconds, and thus a satisfactory image can be output in a short period of time without causing image smudging. Further, since the property is maintained constant by the drum heater, the normal image is continuously output without performing correction of image adjustment.

In the above embodiments, explanation is made on the black and white image forming apparatus, but the present invention is similarly adopted for a color image forming apparatus formed by toners of yellow, magenta, cyan, and black. The color image forming apparatus may be one of a tandem type color image forming apparatus that uses a plurality of photosensitive members or a type in which the image is formed by one drum.

Further, even if the present invention is adopted to a method of setting the conditions of the charging means, the exposing means, the developing means, and the transferring means for transferring the toner image on the photosensitive drum to the intermediate transferring member with the density detection means for detecting the density of the toner image on the photosensitive drum acting as the image bearing member or the toner image on the intermediate transferring member acting as the image bearing member as the image condition detection member for the difference, similar effects are obtained.

The embodiments of the present invention have been explained, but the present invention is not limited in any way to the above embodiments, and various variants within the technical scope of the present invention can be made.

This application claims priority from Japanese Patent Application No. 2004-308686 filed on Oct. 22, 2004, which is hereby incorporated by reference herein.

What is claimed is:

1. An image forming apparatus, comprising:

a rotatable photosensitive member;

image forming means including charging means for charging said photosensitive member, exposing means for exposing said photosensitive member to form an electrostatic image thereon, developing means for developing the electrostatic image formed on said photosensitive member by said exposing means, with toner, and transferring means for transferring a toner image developed by said developing means onto a recording material;

fixing means for fixing the toner image transferred by said transferring means onto the recording material;

a temperature sensor for detecting an environment temperature of the image forming apparatus; and control means for, when said fixing means having a temperature lower than a predetermined temperature is heated up to an image formation allowable temperature, controlling said image forming means to (i) execute a first adjustment process for adjusting an image forming condition of said image forming means in a period of heating said fixing means up to the image formation allowable temperature in a case said temperature sensor detects a first temperature, and (ii) execute a second adjustment process for which a required time period is shorter than that for the first adjustment process in a period of heating said fixing means up to the image formation allowable temperature in a case in which said temperature sensor detects a second temperature higher than the first temperature.

2. An apparatus according to claim 1, wherein when said fixing means having a temperature lower than the image formation allowable temperature and higher than the predetermined temperature is heated up to the image formation allowable temperature, said control means does not execute the adjustment of the image forming condition of said image forming means.

3. An apparatus according to claim 1, further comprising a potential sensor for detecting a potential of said photosensitive member, wherein based on a detection result of said potential sensor, the first adjustment process and the second adjustment process selectively execute one or more adjustment steps among a plurality of adjustment steps including a charge adjustment step of adjusting a charge bias of said charging means for charging said photosensitive member, an exposure adjusting step of adjusting an exposure amount of said exposing means for forming an electrostatic image on said photosensitive member, and a development adjustment step of adjusting a development bias of said developing means for developing the electrostatic image formed on said photosensitive member, and the number of the adjustment steps executed by the first adjustment process is more than that of the adjustment steps of the second adjustment process.

4. An apparatus according to claim 3, wherein in a case in which said image forming means is controlled to execute the second adjustment process in a period of heating said fixing means having a temperature lower than the predetermined temperature up to the image formation allowable temperature, in accordance with input of an image forming signal, said control means controls said image forming means to execute the adjustment steps other than those executed in the second adjustment process, of the plurality of adjustment steps, after the end of image formation instructed by the image forming signal.

5. An image forming apparatus, comprising:

a rotatable photosensitive member;

image forming means including charging means for charging said photosensitive member, exposing means for exposing said photosensitive member to form an electrostatic image thereon, developing means for developing the electrostatic image formed on said photosensitive member by said exposing means, with toner, and transferring means for transferring a toner image developed by said developing means onto a recording material;

fixing means for fixing the toner image transferred by said transferring means onto the recording material;

a humidity sensor for detecting an environment humidity of the image forming apparatus;

a heater for heating said photosensitive member; and control means for, when said fixing means having a temperature lower than a predetermined temperature is heated up to an image formation allowable temperature, controlling said image forming means to (i) execute a first adjustment process for adjusting an image forming condition of said image forming means in a period of heating said fixing means up to the image formation allowable temperature in a case said humidity sensor detects a first humidity level, and (ii) execute a second adjustment process for which a required time period is longer than that for the first adjustment process in a period of heating said fixing means up to the image formation allowable temperature in a case in which said humidity sensor detects a second humidity level higher than the first humidity level.

* * * * *